United States Patent [19]

Jwuc

[11] 4,452,147

[45] Jun. 5, 1984

[54] INTERMODAL RAILWAY CAR

[75] Inventor: Karl J. Jwuc, Tallmade, Ohio

[73] Assignee: The Youngstown Steel Door Company, Cleveland, Ohio

[21] Appl. No.: 242,516

[22] Filed: Mar. 10, 1981

[51] Int. Cl.[3] ..... B61F 5/14; B61D 3/10

[52] U.S. Cl. ..... 105/4 A; 105/4 R; 105/418; 105/419; 410/56; 410/65

[58] Field of Search ..... 105/4 R, 4 A, 3, 404, 105/418, 419, 413, 414, 158 A; 410/56, 58, 65

[56] References Cited

U.S. PATENT DOCUMENTS

| | | | |
|---|---|---|---|
| 809,734 | 1/1906 | Ostrander | 105/419 |
| 1,456,839 | 5/1923 | Westlake | 105/4 R |
| 2,104,840 | 1/1938 | Stucki | 105/4 R |
| 2,638,852 | 5/1953 | Bannen | 165/159 |
| 2,914,003 | 11/1959 | Seel et al. | 410/65 |
| 2,971,478 | 2/1961 | Dilworth et al. | 105/368 |
| 3,051,098 | 8/1962 | Gutridge | 105/368 |
| 3,102,497 | 9/1963 | Candlin et al. | 105/416 |
| 3,102,646 | 9/1963 | Clejan | 214/152 |
| 3,151,575 | 10/1964 | Dickey et al. | 165/453 |
| 3,223,052 | 12/1965 | Gutridge et al. | 105/454 |
| 3,238,899 | 3/1966 | Gutridge et al. | 105/414 |
| 3,266,441 | 8/1966 | Pulcrano | 105/419 |
| 3,313,246 | 4/1967 | Koo | 105/454 |
| 3,357,371 | 12/1967 | Gutridge | 105/414 |
| 3,509,829 | 6/1967 | Henriksson et al. | 105/368 |
| 3,540,384 | 11/1970 | Charles | 105/418 |
| 3,659,724 | 5/1972 | Miller et al. | 105/419 |
| 3,721,199 | 3/1973 | Hassenaur | 105/366 A |
| 4,213,400 | 7/1980 | Snyder et al. | 105/199 C |
| 4,233,909 | 11/1980 | Adams et al. | 105/4 R |

OTHER PUBLICATIONS

Band O 'Articulates' Piggy Back Cars, Railway Locomotives and Cars, Feb. 1960.

*Primary Examiner*—Bruce H. Stoner, Jr.
*Assistant Examiner*—James E. Barlow
*Attorney, Agent, or Firm*—Fay & Sharpe

[57] ABSTRACT

Disclosed is an intermodal railway car 100 capable of carrying a number of different designs of highway vehicle trailers or cargo containers used to ship goods over such distances as will make railway transportation of such trailers or containers economically advantageous over other forms of transporting such goods to the marketplace. The intermodal railway car 100 is designed with a reduced profile vertically and laterally to allow clearance of Association of American Railroads clearance diagram-plae "B". Furthermore, the car is designed to minimize cost in terms of the use of standard railway trucks 108 to support more than one intermodal railway car 100 thereby reducing the number of trucks 108 and the expense thereof for the construction of such intermodal railway cars 100 by the factor of the number of intermodal railway cars 100 minus one. The intermodal railway car 100 incorporates an articulated connection 114 that can be arranged on either end of the intermodal railway car 100 so as to permit the joining of such intermodal railway cars 100 into groups of two or more so as to significantly reduce the overall production costs thereof while obtaining and maintaining the substantial benefits of versatility for the carrying of highway vehicle trailers or containers.

2 Claims, 11 Drawing Figures

INTERMODAL RAILWAY CAR

BACKGROUND OF THE INVENTION

1. Field of the Invention

The present invention relates generally to a new intermodal railway car having the substantial benefits of a reduced profile vertically and laterally that will meet the plate B requirements of the Association of American Railroads while carrying a variety of over the highway vehicle trailers and cargo containers for railway transport. More specifically, the present invention relates to a design for intermodal railway car utilizing the substantial cost savings of sharing standard railway trucks by articulated connections between two or more or such intermodal railway cars while having the substantial structural integrity of extended side sills and stub center sills to provide a depressed center structure for the carrying of a variety of highway vehicle trailers and cargo containers for railway transport.

2. Description of the Prior Art

With the advent of interstate highway systems, over the highway vehicle travel for the transport of goods to and from the marketplace has become a substantial portion of the transport service volume from domestic manufacturers and suppliers. With the more recent energy crunch causing the cost of the fuel for the operation of such vehicular traffic to rise substantially thus increasing the cost of such mode of transportation for goods, ways have been sought to utilize the more effective means of railway transport of such goods. It has been found that an effective mix of railway and over the highway vehicles would be one where the railway is utilized to transport the goods over the long distances ending at stations whereby the over the highway vehicles can deliver the goods to the nearby areas not directly served by railway spur lines. Thus, the search for railway vehicles or railway cars that would be capable of carrying such over the highway vehicle trailers and containers began.

As early as the 1950's, such designs began to be seen in the patent literature and exemplified by U.S. Pat. Nos. 2,638,852; 2,971,478; 3,051,089; 3,102,497; 3,102,646; 3,151,575; 3,238,899; 3,223,052, 3,313,246 and 4,233,909. All of these cited references have one common theme in that the idea was to utilize over the highway vehicle trailers and containers to ship the goods but allowing them to transport over the railway system for long distances for the economies that could be derived therefrom. Of these designs, one of the major drawbacks was that in each case there was a central structural member necessary for the maintenance of the structural integrity of the units for such railway travel and as a result thereof, these units had difficulty in terms of carrying wheeled over the highway vehicle trailers due to the restrictive clearances for the railway system.

The early designs utilize a flatbed concept and generally one railway car on a set of two trucks thus the substantial burden of producing two sets of trucks for each railway car in accordance with the prior art. As it became apparent that these prior art designs had very limited capabilities in terms of the selection of various over the highway vehicle trailers and containers that they could carry and still meet the height requirements of the Association of American Railroads (referred to as AAR) for the transport on the American railway system, more recent designs began to evolve in which a depressed center portion was utilized in order to lower the overall height of such railway cars.

U.S. Pat. No. 3,357,371 was such a later development wherein the attempt was made to depress the center of the railway car to accomplish an overall lowering of the height of the container or over the highway vehicle trailers with wheels on it so as to more amply comply with the height requirements for operation on the railway system. Some of the problems associated with this design include the fact that the structure is complicated and thus more costly to construct and that the length of the lowered space for the acceptance of cargo containers or the rubber tired vehicle trailers is limited which limits the usefulness of the railway car for carrying forty-five foot trailers. Also this car in each case utilizes two railway trucks for its support and thus does not accomplish the cost savings as might be desired for a long container train.

A later design was found in U.S. Pat. No. 3,509,829 wherein a depressed center was used to provide a railway car which could contain highway vehicle trailers to be within the height requirements and did for the first time utilize two railway cars on one truck for what is generally referred to as an articulated connection. Some of the problems associated with this particular kind of car were the fact that the coupler height on this car was considerably lower than that of standard freight cars and thus if this railway car were to be put into a train containing a mixture of freight cars and these railway cars an elevator coupler mechanism was necessary to achieve equal height with the couplers of other standard cars. Also, the articulated connection of this kind of car was extremely limited in terms of the angular diposition available for cornering of the car around sharp curves that might result in certain portions of the U.S. railway track system.

Thus, these present designs have been found inadequate for many reasons but particularly for: the lack of an articulated connection which provides a coupler height equal to that of the standard car, that the depressed center portion of the car limits significantly the range of various types of containers or highway vehicle trailers that might be used on such railway cars, and the problem of carrying forty-five foot trailers

SUMMARY OF THE INVENTION

It is therefore an object of the present invention to provide a mechanical structure for an intermodal railway car which will meet the plate B AAR Clearance Standards when hauling as cargo a variety of types of trailers and containers including the forty-five foot trailers on intermodal railway car.

It is another object of the present invention to provide a depressed center intermodal railway car of such design as to maximize the ability of such railway car to meet the height requirements with rubber tired vehicle trailers loaded thereon in accordance with the Plate B Clearance Standards of the AAR.

It is still another object of the present invention to construct an intermodal railway car designed to minimize material and labor costs in the assembly and construction of such intermodal railway cars.

It is a further object of the present invention to reduce the profile vertically and laterally to obtain reduced wind resistance to maximize the fuel efficiency of the intermodal railway car.

It is still another object of the present invention to further reduce the economic costs of construction of such intermodal railway cars by utilizing an articulated connection between several cars upon a limited number of railway trucks thereby reducing substantially the costs of such construction.

These and other objects of the present invention, together with the advantages thereof over existing and prior art forms which will become apparent to those skilled in the art from the detailed disclosure of the present invention as set forth hereinbelow, are accomplished by the improvements herein shown, described and claimed.

It has been found that an intermodal railway car for the transportation of various types of over the highway vehicle trailers and containers can comprise: a set of two fabricated side sills; at each end thereof and connected therebetween a structural web; the structural webs terminating in a stub center sill; the stub center sill having a pivotal connection with and between a railway truck for traversing over the railway; a depressed center structure to provide support for rubber tired vehicle trailers or containers as may be placed therein; the depressed center structure being depressed in an amount sufficient to allow the intermodal railway car to meet the Plate B height restrictions when carrying a rubber tired over the highway vehicle trailer; and the depressed center structure being supported by and attached to the side sills.

It has also been found that an intermodal railway car for the transportation of rubber tired vehicle trailers or containers over the railway may comprise two or more such intermodal railway cars having a number of standard railway trucks equal to the number of intermodal railway cars plus one; articulated connections on at least one end of each intermodal railway car; the articulated connections having a stub center sill for pivotal connection to the standard railway truck; and the articulated connections also having at least one set of extension arms terminating in a side bearing connection to the standard railway truck.

The preferred embodiment of the subject intermodal railway car is shown by way of example in the accompanying drawings without attempting to show each and every of the various forms and modifications in which the invention might be embodied: the invention being measured by the appended claims, not by the details of this disclosure.

DESCRIPTION OF THE PREFERRED EMBODIMENT

Figure 1:
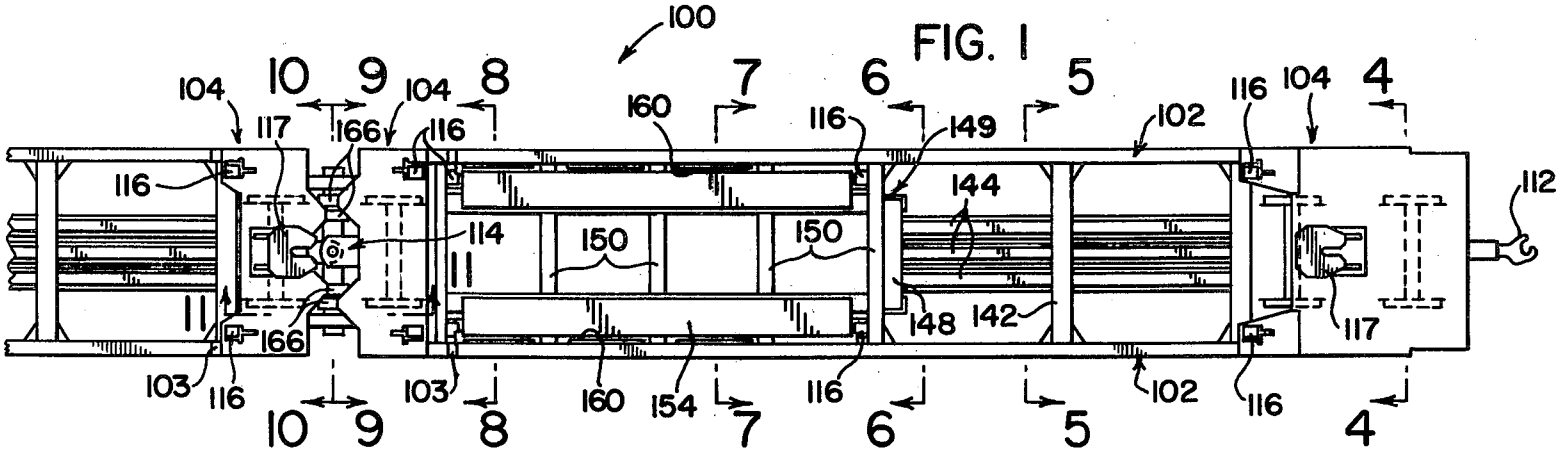
FIG. 1 is a top elevation view of the intermodal railway car according to the concepts of the present invention.

The intermodal railway car generally referred to as numeral 100 of the instant drawings as seen in those drawings represents a new type of railway car design for rail transportation of rubber tired highway vehicle trailers and containers as used for over the highway travel of packaged or containerized cargo which is becoming a significant portion of the mass cargo transportation market today. The reason for this shift toward containerization of cargo is the convenience and efficiency for handling the cargo in this fashion. A further efficiency is achieved by allowing such trailers and cargo containers to be directly unloaded from a over the highway vehicle onto a railway car for the most efficient long distance hauling to off loading at a distant site.

The intermodal railway car 100 generally is constructed of a system of fabricated side sills 102 connected at either end thereof by means of structural webs 104 generally having stub center sills 106 for direct pivotal connection to a standard railway truck 108. As can be particularly seen from FIGS. 1, 2 and 3 of the drawings, the central portion of the intermodal railway car 100 utilizes the most efficient means of reducing weight while providing structural integrity through a depressed center structure generally referred to by numeral 110. Such a depressed center structure 110 accomplishes the overall weight reduction necessary for efficient over the rail transportation of such a car while still providing significant structural integrity to the intermodal railway car 100 and the necessary capacity for handling various types of rubber tired over the highway vehicle trailers and containers. The intermodal railway car 100 has a particularly reduced profile so as to permit the carrying of the rubber tired over the highway vehicle trailers in a fashion which will meet the basic requirements of Plate B specifications of clearance set forth by the Association of American Railroads also known as the AAR.

It is significant to note that the side sills 102 of the intermodal railway car 100 are higher from the rail surface than the depressed center structure 110 of the intermodal railway car. In this fashion, the fabricated side sills 102 are nearly level with the coupling height from the rail to provide the ability for this intermodal railway car 100 to be utilized with standard railroad rolling stock of various types and mixtures for more efficient and mixed operation.

Figure 2:
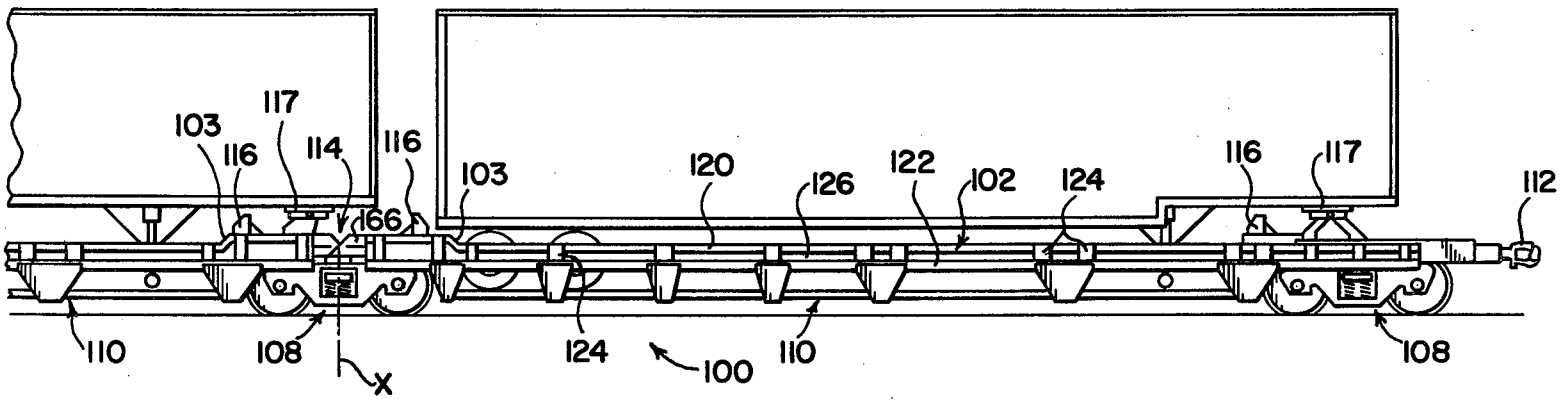
FIG. 2 is a side elevation view of the intermodal car having thereon rubber tired vehicle trailers for transport over the railway system.
Figure 3:
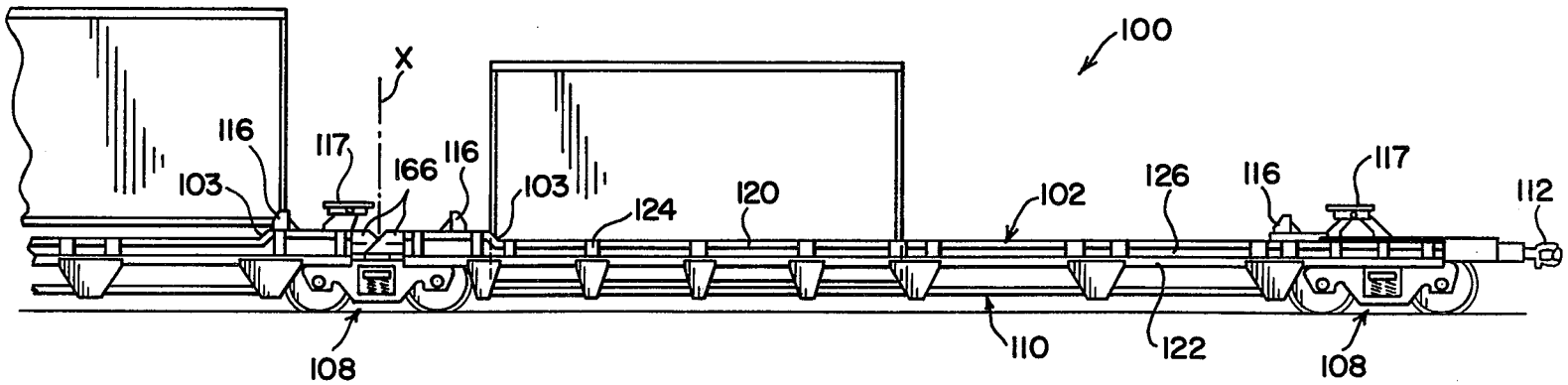
FIG. 3 is a side section view of the intermodal railway car having contained thereon containers for transport over the railway system.

As seen in FIGS. 2 and 3, the side sills 102 have side sill steps 103 at each end thereof so that the central portion of side sills 102 may be lowered to accomodate drop frame vehicle trailers seen in FIG. 2. This is to allow room for the lifting apparatus to be extracted horizontally from the vehicle trailer during the process of lifting the vehicle trailer onto the intermodal railway car 100. As those skilled in the art will realize, if drop frame vehicle trailers are not to be accomodated, the side sills 102 could be level thus eliminating the extra construction features of the side sill steps 103.

The couplers 112 of the intermodal railway car 100 would be provided on each end of the intermodal railway car 100 if individually used or on each end of a series of intermodal railway cars 100 to provide a convenient coupling means to standard rolling stock for rail transport. The central intermodal railway cars 100 would be provided with an articulated connection 114 as seen from the drawings to obtain an additional efficiency for operation of such intermodal railway cars 100 by eliminating nearly one-half of the standard railway trucks 108 necessary to support the intermodal railway cars 100 for rail transport.

A unit train could contain an almost indefinite number of intermodal railway cars 100 for long distance rail transport of containerized cargo or rubber tired vehicle trailers. In any given intermodal railway car unit train, the number of standard railway trucks 108 would equal the number of intermodal railway cars 100 plus one (1). Thus, it can be seen that a significant savings in terms of expenditure for such standard railway trucks 108 can be achieved and at the same time reduce the rolling resistance of the intermodal railway cars 100 in such a unit train. It is expected that the more popular method of connecting the intermodal railway cars 100 would be in groupings of two or six intermodal railway cars 100 each of which may have either two articulated connections 114 or an articulated connection 114 and a standard coupler 112.

It can be seen particularly in FIG. 1 of the drawings that the depressed center structure 110 of the intermodal railway car 100 while being designed as to provide structural integrity to the overall design of the intermodal railway car 100 also provides a convenient resting zone for the tires of a rubber tired vehicle trailer. The depressed center structure 110 can be divided so as to provide the wheel resting zones toward one end of the intermodal railway car 100 and a stand conveniently to accept the coupling device of the fore end of a rubber tired vehicle trailer. As seen particularly in FIGS. 2 and 3 of the drawings, the intermodal railway car 100 having the depressed center structure 110 depressed from the height of the fabricated side sills 102 provides a convenient area for the placement of the tires of such trailers to reduce the overall height of a loaded intermodal railway car 100 so as to meet the Plate B requirements of the AAR.

As illustrated by FIGS. 2 and 3, the intermodal railway car 100 is designed to accept various combinations of containers and trailers so as to provide a fuel efficient manner for rail transport. Specifically, the intermodal railway car 100 is designed to accept reefer trailers so that the reefers will not be the cause of any clearance problems during transit. Container brackets 116 are appropriately placed in the intermodal railway car 100 to accept the corners of containers to achieve stable loading of the containers on the intermodal railway cars 100 for rail shipment. FIG. 3 shows the use of container brackets 116 on top of the side sills 102 to accept the long containers where this arrangement will meet the height requirements of the railway being traversed. As further seen in FIG. 8 of the drawings, container brackets 116 may also be positioned in the depressed center structure 110 to accomodate shorter containers. This of course lowers the overall height to allow compliance with more stringent railway height requirements.

The container brackets 116 may be made of any convenient design, many different designs of which will occur to those skilled in the art. The main requirements for the container brackets 116 are that they accept the corners of the container and hold the horizontal position of the container secure and stable during transit.

It will also be noticed that stands 117 are provided for suitable stable resting positions for the front end coupler of rubber tired vehicle trailers. As with container brackets 116, they may be of any convenient design which will provide the required stable support for the rubber tired vehicle trailer front coupler for railway transport.

Figure 4:
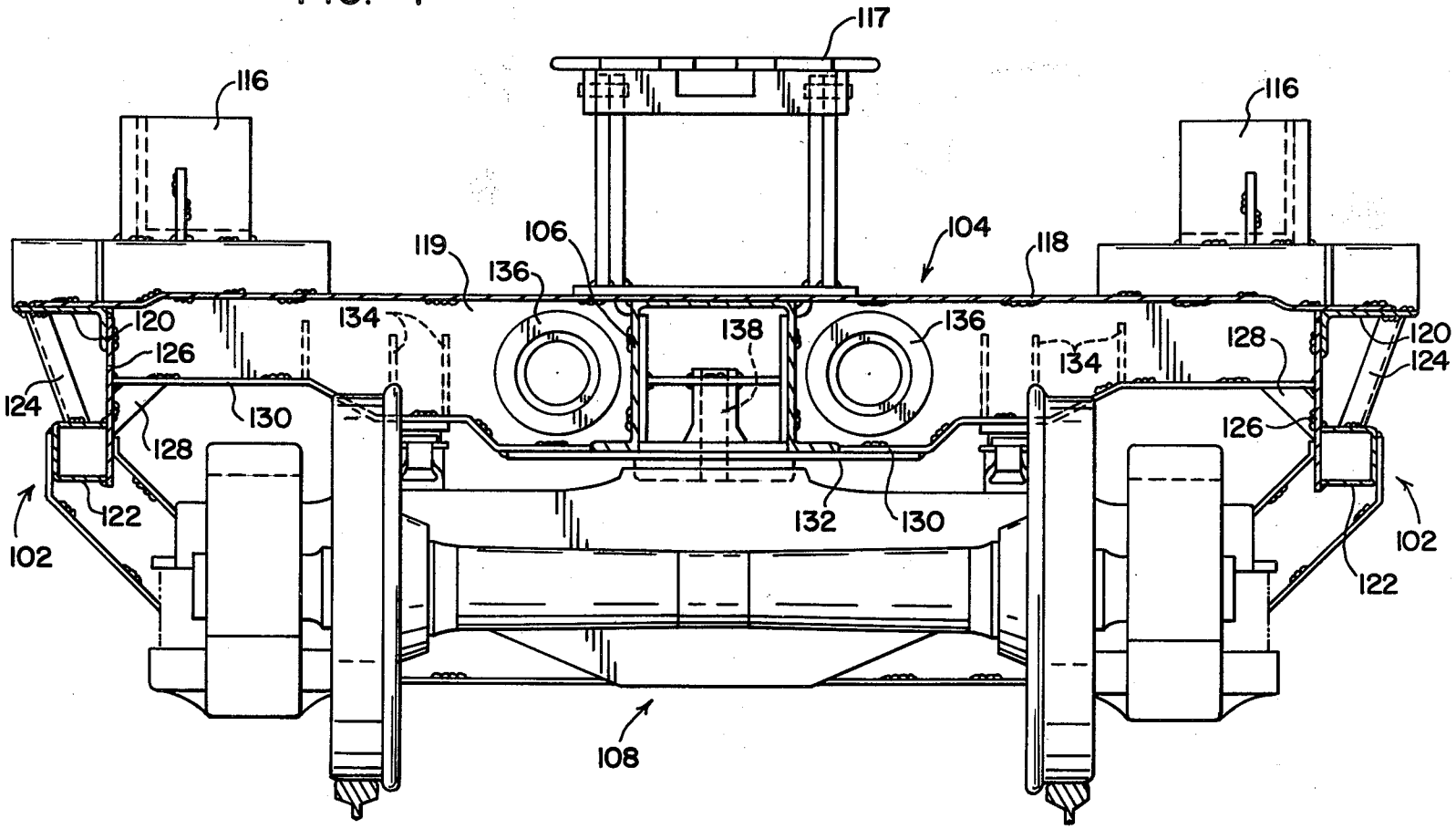
FIG. 4 is a side section view of the intermodal railway car taken substantially along line 4—4 of FIG. 1.
Figure 5:
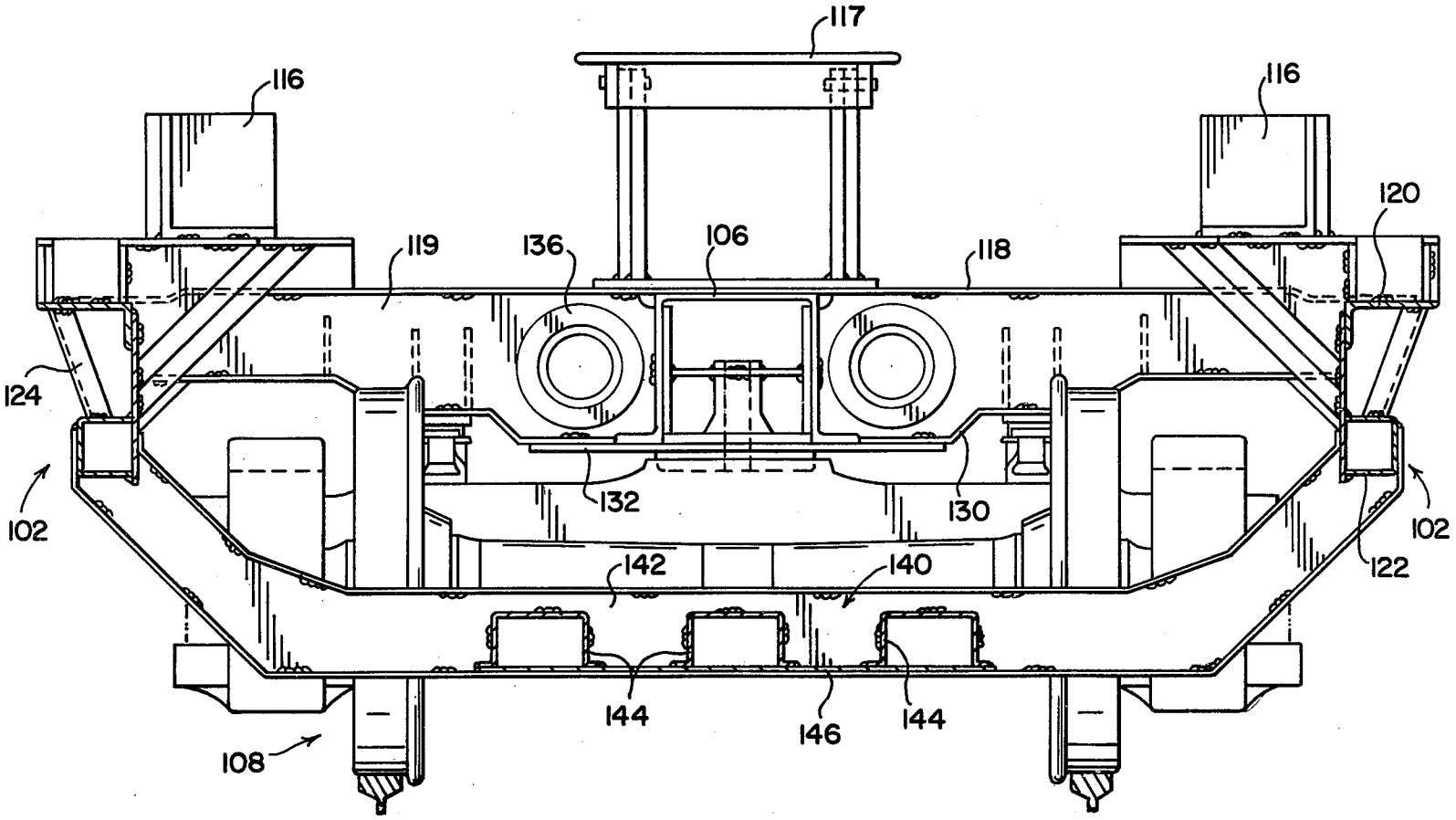
FIG. 5 is a side section view of the intermodal railway car taken substantially along line 5—5 of FIG. 1.

Referring to FIG. 1 of the drawings, it can been seen that the sectional drawings 4 through 11 are keyed as to provide reference from FIG. 1 for those skilled in the art as to the fabrication of the intermodal railway car 100 in the various sections as seen. Particularly FIG. 4 shows the basic construction of the standard coupler 112 end of intermodal railway car 100. The standard coupler 112 end of intermodal railway car 100 has a structural web 104 as shown in FIG. 4 of the drawings interconnected between and to the fabricated side sills 102. The arrangement includes a top plate 118 resting on top of the fabricated side sills 102 and a web plate 119. The web plate 119 could be of standard AAR box type construction or of a single plate type construction as will occur to those skilled in the art.

The fabricated side sills 102 are constructed by permanently joining a side sill angle 120 to a side sill channel 122 by means of side struts 124 on the outward side of the intermodal railway car 100 fabricated side sills 102. On the inside portion of the fabricated side sills 102 is a flat plate 126 which is permanently connected to the structural webs 104 as seen in FIG. 4 as well as to the side sill angle 120 and the side sill channel 122. Since the side struts 124 are reinforcing members for the side sills 102 it is anticipated that those skilled in the art will be readily able to substitute many structural shapes capable of performing this reinforcement function. As shown in FIG. 4 the side struts 124 are made of formed channel stock, however, flat plate, apertured flat plate, rectangular tubing or round tubing would also perform the required function.

The side sills 102 as shown in FIG. 4 are slightly lower than the top edge of the structural web 104 which in this case causes the need for an offset bend in top plate 118. If desired however, the side sills 102 may be made flush with the top of the structural web 104 to allow the use of a flat top plate 118 or a filler plate not shown which may be added on top of the side sill angle 120 to bring the side sill 102 up flush with the top of the structural web 104.

The fabricated side sills 102 are also structurally bolstered in their permanent attachment to the structural webs 104 by means of bottom gusset plates 128 which are connected between the bottom plate 130 of the structural webs 104 and flat plate 126 of the side sills 102. Near the center of the structural web 104 can be found the stub center sill 106 which in the case of FIG. 4 is directly connected to the standard coupler 112. The stub center sill 106 is tied to the structural web 104 as a component thereof by means of a tie plate 132 and the bottom plate 130 of the structural web 104. The stub center sill 106 is also connected by permanent means to the top plates 118 of the structural web 104. The stub center sills 106 may be constructed according to any of the conventional designs such as two Z members or flat plates.

The structural web 104 may be also reinforced and strengthened by means of placing web supports 134 in various positions along the bottom plates 130 of the structural web 104 and also along the top plate 118 which is not shown in FIG. 4. Furthermore, the larger more open area of the structural webs 104 can be strengthened and reinforced by means of web reinforcing rings 136 as seen in FIG. 4 so as to provide a high degree of structural integrity to the overall structural web 104 construction.

Furthermore as seen in FIG. 4 of the drawings at the intersection of the stub center sill 106 and the top plate 118, a stress relief aperture is left in each corner to prevent stress from building up in this region. Such stresses could result in premature failure of some of the components of the structural web 104 which would be detrimental to the structural integrity of the intermodal railway car 100.

The structural web 104 as seen in FIG. 4 of the drawings is connected to a standard railway truck 108 as shown by means of a pivotal connecter pin 138 to provide for pivotal movement of the intermodal railway car 100 upon the standard railway truck 108 for curve negotiating ability of the intermodal railway car 100 in a fashion similar to that of a standard railway rolling stock.

In the fore end of the intermodal railway car 100, the depressed center structure 110 takes the form of a structural stringer 140 connected in a permanent fashion by means of cross ties 142 to the fabricated side sills 102 to provide a structural integrity to the fore end of the intermodal railway car 100. The composition of the structural stringer 140 includes a stiffener structural shape such as hats 144 having a structural stringer base plate 146 connected to hats 144 and a structural stringer top plate 148 also connected to hats 144. The structural stringer base plates 146 are connected to the cross ties 142 and in such a way that the structural stringer base plate 146 becomes the bottom plate of the cross tie 142 as it connects to the fabricated side sills 102. In this way, the fore end of the intermodal railway car 100 presents a depressed center portion structurally connected to the fabricated side sills 102.

The structural stringer 140 may stretch the entire length of the intermodal railway car 100 to provide a lighter weight embodiment for container handling. Such alternative embodiments would be very useful in meeting the New York City area plate restrictions which are more severe than the plate "B" restrictions.

Furthermore, the structural stringer 140 may be connected to a central connector 149 to provide the illustrated embodiment to carry a variety of containers and rubber tired vehicle trailers. As seen in FIG. 1, the central connector 149 may be in approximately the longitudinal center of the intermodal railway car 100 but the central connector 149 may be placed anywhere the builder desires to achieve the capability to carry the various types of containers and trailers the intermodal railway car 100 is being constructed to carry.

Figure 6:
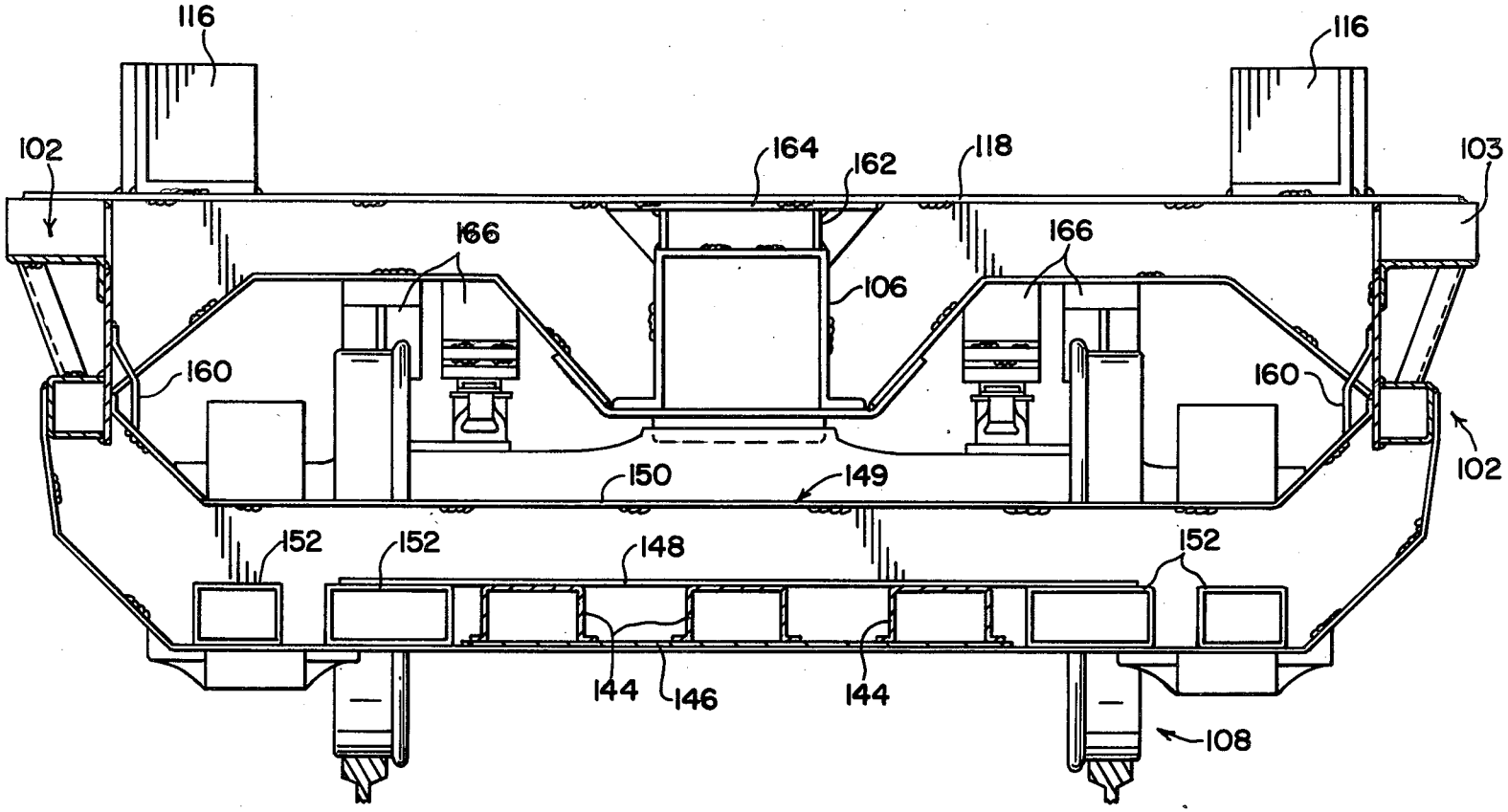
FIG. 6 is a side section view of the intermodal railway car taken substantially along line 6—6 of FIG. 1.

FIG. 6 of the drawings shows the depressed center structure 110 at the central connector 149 in the intermodal railway car 100 whereby the fore end structural stringer 140 is connected to a structural cross tie 150 directly by hats 144, the structural stringer base plate 146 and structural stringer top plate 148 to the end tubular tire rest stringers 152 found in the aft portion of the intermodal railway car 100. The central connector 149 is a transition member from the structural stringer 140 to the tubular tire rest stringer 152 in a manner to assure the overall strength of the depressed center structure 110.

Figure 7:
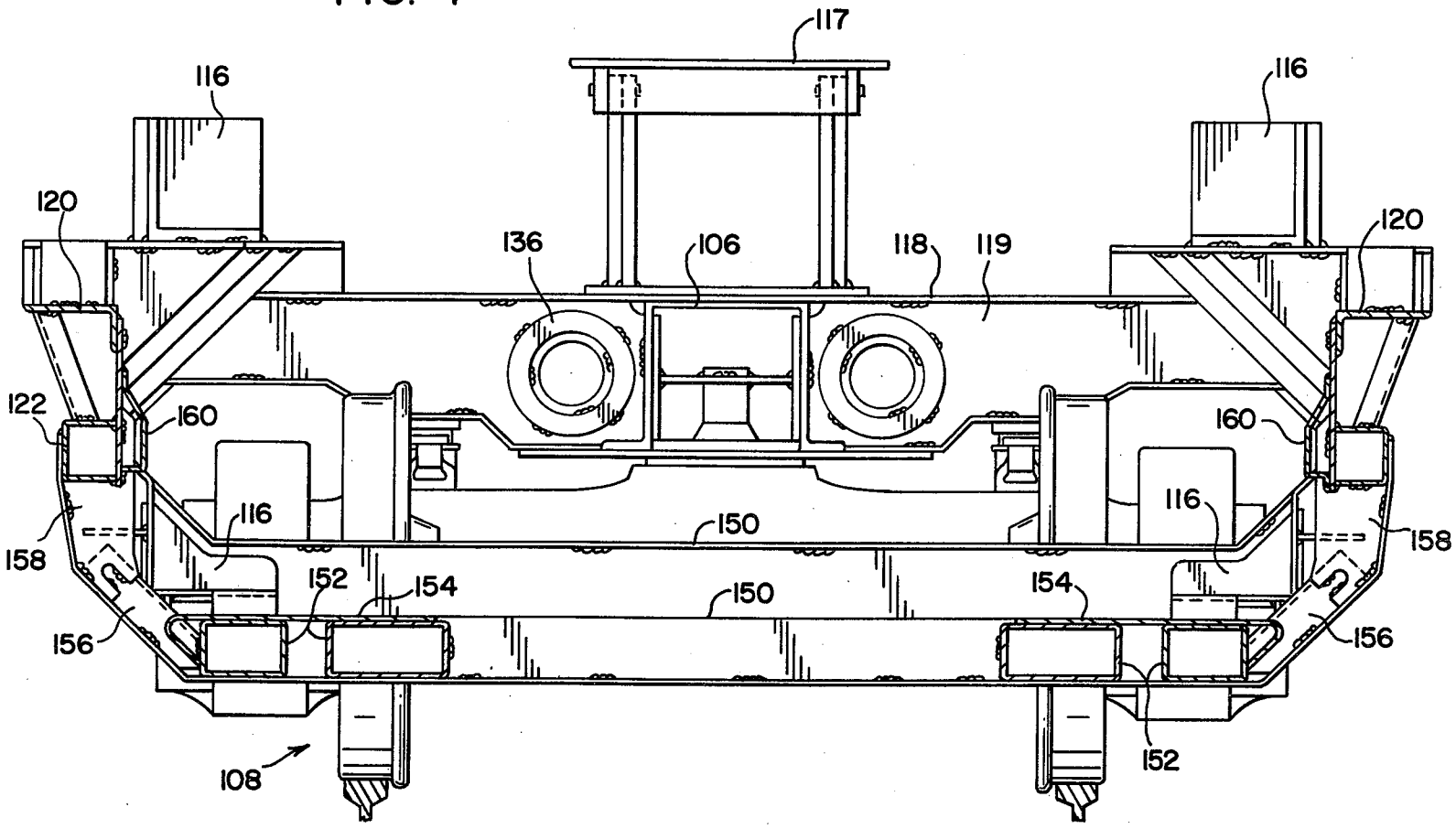
FIG. 7 is a side section view of the intermodal railway car taken substantially along line 7—7 of FIG. 1.

FIG. 7 of the drawings shows the aft end of the intermodal railway car 100 particularly showing the depressed center structure 110 as constructed of a stiffener structural shape such as tubular tire rest stringers 152 having attached to the top portion thereof surface sheets 154 upon which the tires of a rubber tired over the highway vehicle trailer can rest in a convenient fashion. Also as found in the aft end of the intermodal railway car 100, the tubular tire rest stringer members 152 are connected to cross ties 150 in a fashion similar to that of the cross ties 142 in the fore end of the intermodal railway car 100. In this situation however, the cross ties are composed of cross tie side channels 156 which are in turn connected to cross tie side supports 158 which are connected in turn to the fabricated side sills 102. The tubular tire rest stringer 152 surface sheets 154 may be constructed of solid sheet material, apertured sheet material, expanded metal mesh material or any of these materials in combination with a structural shape for stiffening of the surface sheets 154. The main concept calls for the surface sheets 154 to be tied to the tubular tire rest stringer 152 in a way that will provide longitudinal stiffening to the intermodal railway car 100.

Also as seen in FIG. 7, a tire guide 160 may be conveniently placed along the inside portion of the fabricated side sills 102 to keep the rubber tired over the highway vehicle trailers more or less centered in the intermodal railway car 100 during railway transit.

Figure 8:
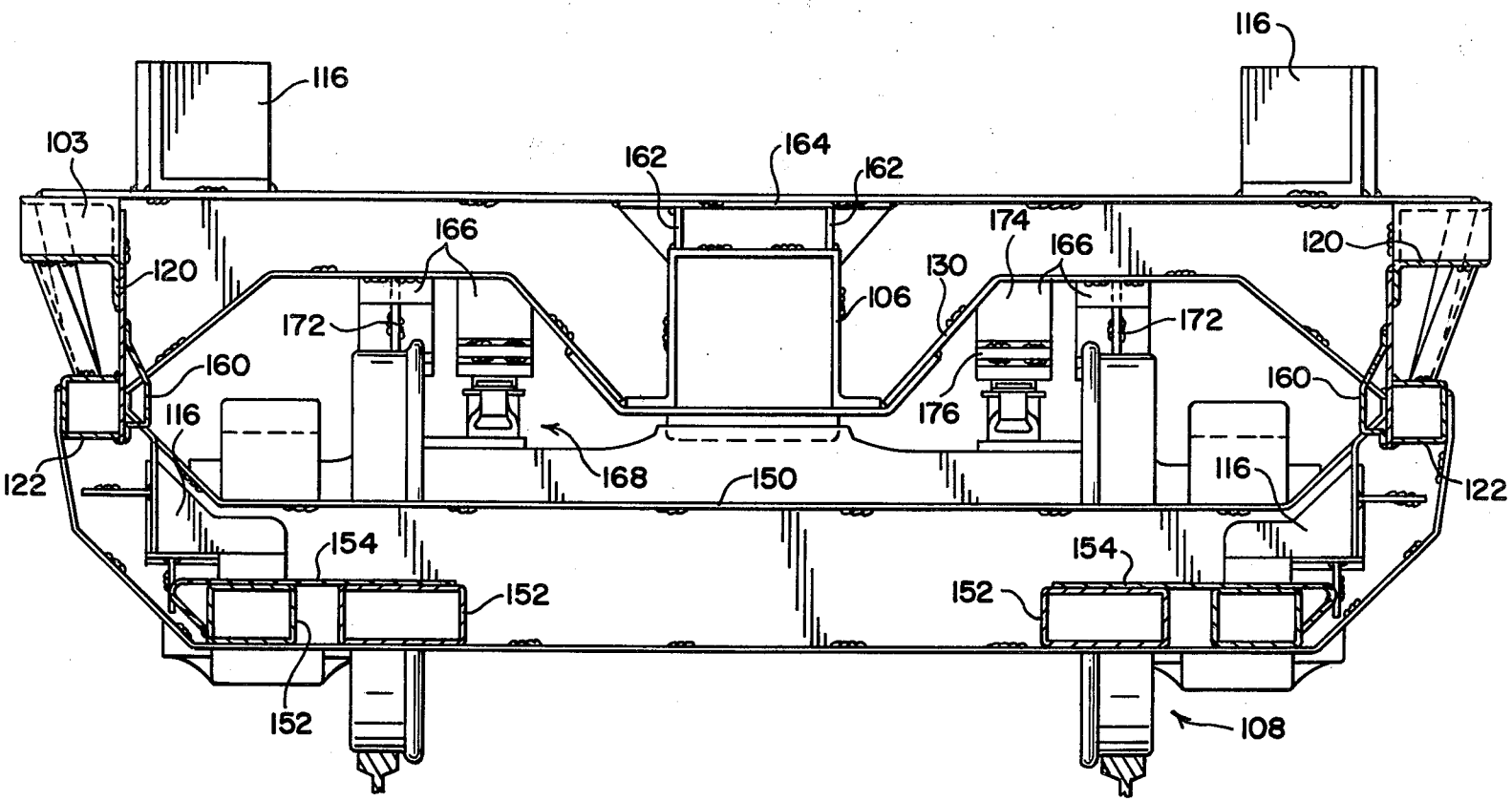
FIG. 8 is a side section view of the intermodal railway car taken substantially along line 8—8 of FIG. 1.

FIG. 8 of the drawings shows the manner in which the tubular tire rest stringers 152 are connected to a structural cross tie 150 near the aft end of the intermodal railway car 100 as seen facing the articulated connection 114 end of the intermodal railway car 100. Contained in the corners of the depressed center structure 110 are container brackets 116 which may be constructed in any of a number of standard configurations to handle the corners of a container as will be readily known by those skilled in the art.

Figure 9:
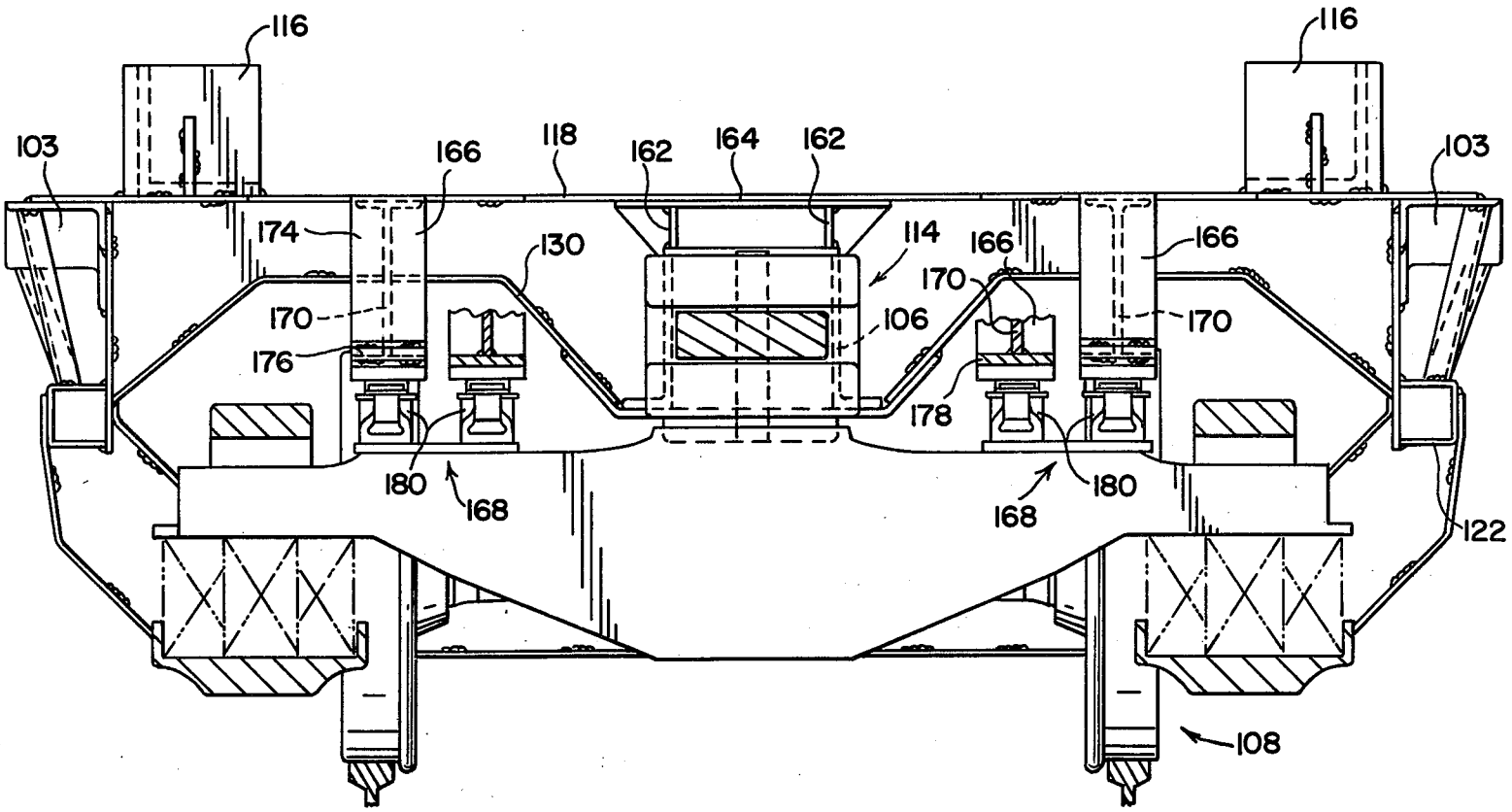
FIG. 9 is a side section view of the intermodal railway car taken substantially along line 9—9 of FIG. 1.
Figure 10:
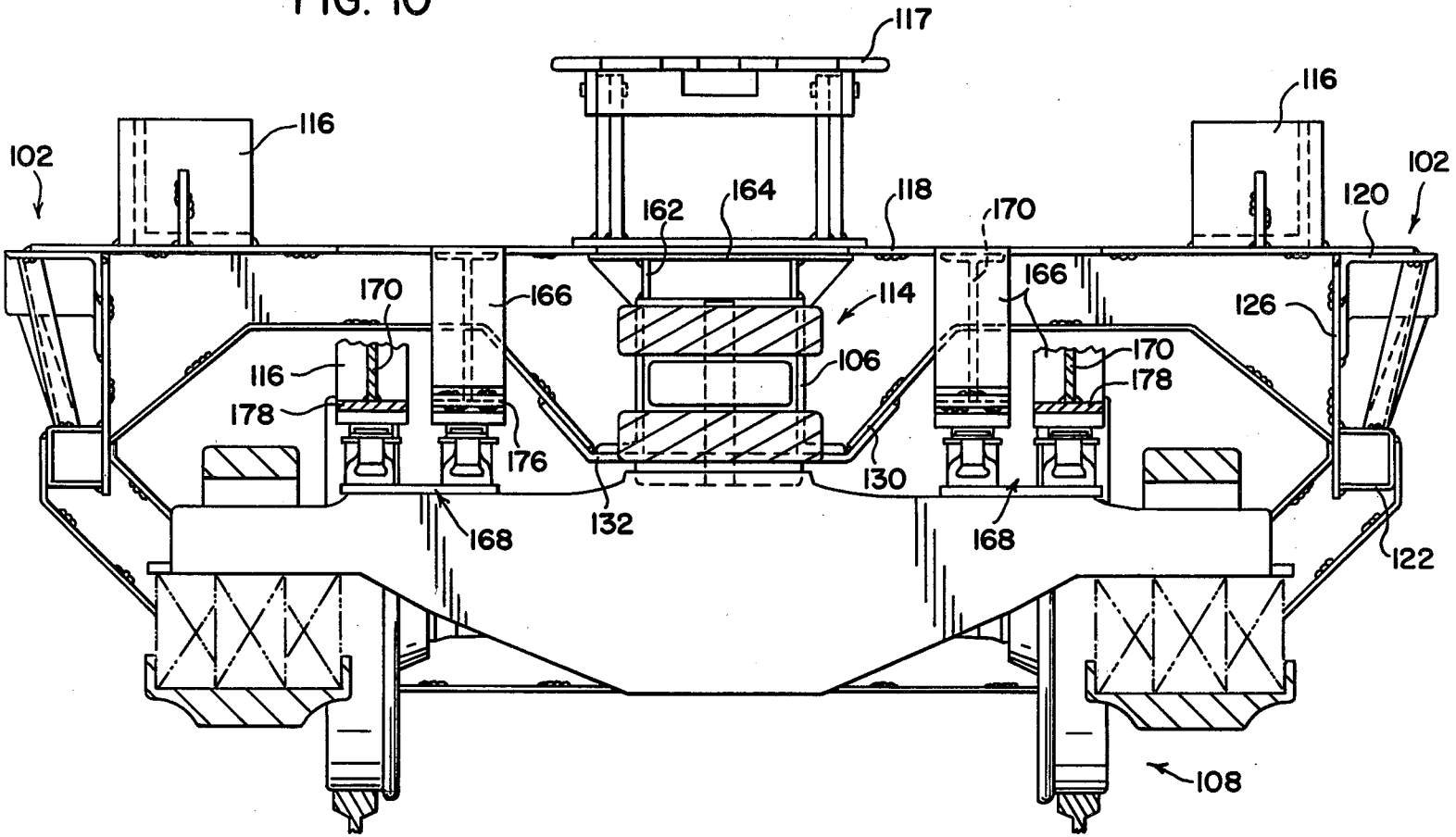
FIG. 10 is a side section view of the intermodal railway car system taken substantially along line 10—10 of FIG. 1.

FIGS. 9 and 10 of the drawings illustrate from two directions sectional views of an articulated connection 114 for the intermodal railway car 100 so as to provide the substantial economies involved in the production of intermodal railway cars 100 with standard railway trucks 108 in a number equal to the number of intermodal railway cars 100 plus one. The articulated connection 114 joint member may be of conventional design as amply illustrated by U.S. Pat. No. 3,646,604. This cuts the cost of standard railway trucks 108 by a factor of at least 25% when only two intermodal railway cars 100 are interconnected permanently and by a factor of up to 50% when a large number of such intermodal railway cars 100 are so connected by articulated connections 114.

It can be seen in this case that the structural webs 104 are similar to those seen in FIG. 4 with the major exception being that the stub center sills 106 are extended to a greater height by means of two stub center sill side fillers 162 and one stub center sill top filler plate 164 to provide the adequate height necessary for the extension arms 166. As can be seen by looking jointly at FIGS. 9 and 10, the articulated connection 114 utilizes the concept of a bifurcated side bearing system 168 as shown. Each individual intermodal railway car 100 can be supported by two side bearings on the standard railway truck 108 in a fashion similar to that utilized for a standard railway car. Thus, the extension arms 166 will extend from each intermodal railway car 100 to allow each extension arm 166 to pass by the extension arm 166 from the other opposing intermodal railway car 100 extension arm 166.

Figure 11:
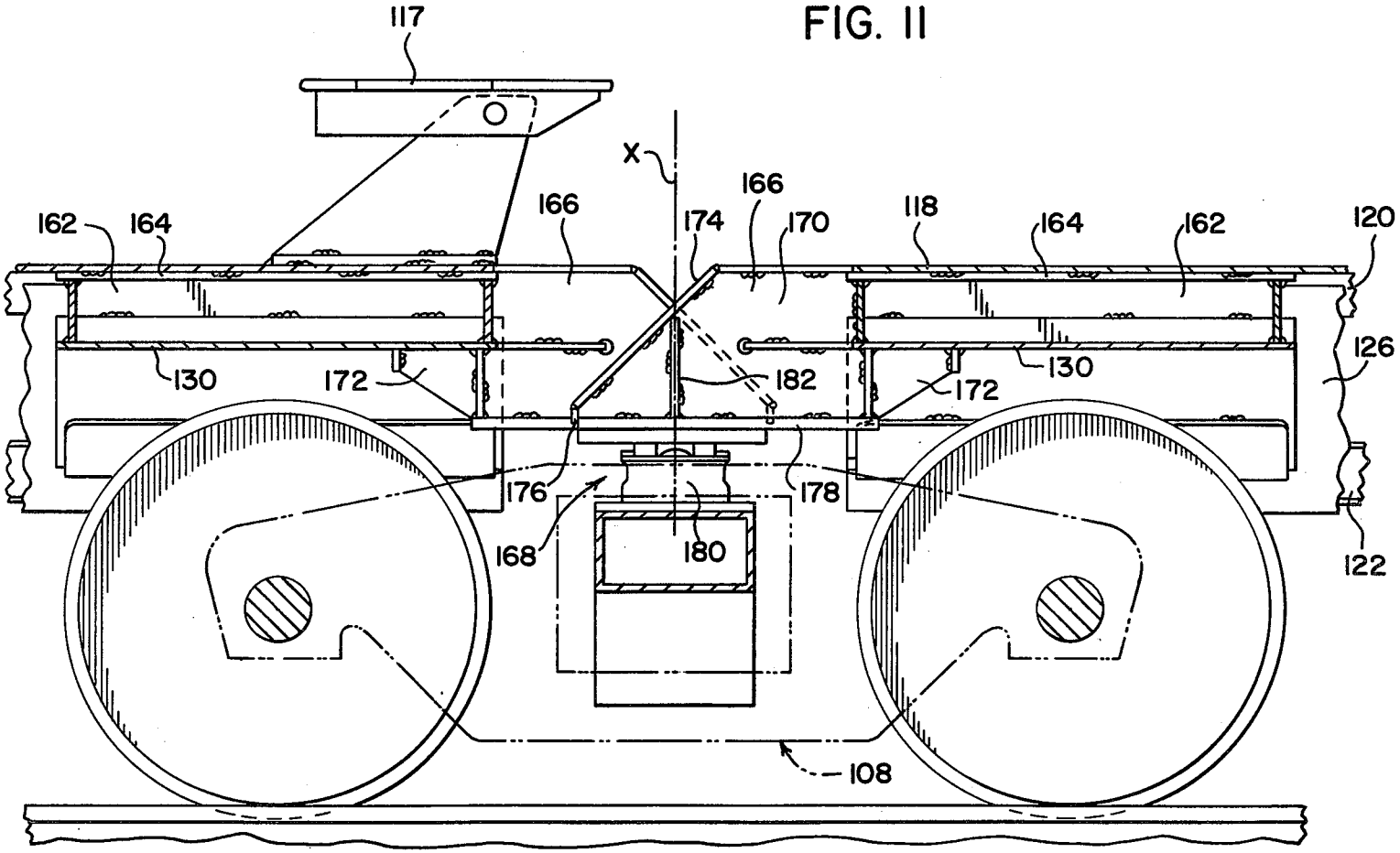
FIG. 11 is a partial longitudinal sectional view of the intermodal railway car system taken substantially along line 11—11 of FIG. 1.

The extension arms 166 are connected integrally to the intermodal railway car 100 at top plates 118 which form the top section of the structural webs 104. The extension arms 166 are fabricated structural members of sufficient integrity to support the side cage bearing in a normal manner. As particularly seen in FIG. 11 which shows a side section view of the extension arms 166, it can be seen that this particular embodiment employs the use of an I-shaped beam 170 integrally connected to the top plate 118 and to the bottom plate 130 of the structural web 104. Reinforcement is provided by means of gusset plates 172. The bottom plate 130 of structural web 104 is extended into the central portion of the I-shaped beam 170 so as to provide additional strength in the area of the extension arm 166 forward most reach. Across the end portion of the I-shaped beam is found a cap plate 174 on each extension arm with front filler plates 176 and bottom filler plates 178 to provide the required surface area for the resting zone upon the side bearing 180. At a point approximately centered over the side bearing 180 is a further vertical tie plate 182 between the cap plates 174 and the bottom filler plates 178 and also permanently connected to the I-shaped beam 170. This adds vertical stiffening to the extension arms 166 at the point of highest vertical strain on the extension arms 166.

The side bearings 180 may be of conventional design and manufacture such as the Stucki side bearing cages utilized on most 70 ton standard railway trucks 108. With all of the extension arms 166 in place, you will have four independent Stucki bearings 180 supporting four extension arms 166 in a given articulated connection 114 which will generally have an angular disposition limit of approximately 10% relative to the horizontal. This is particularly helpful to isolate the mechanical motion of the various intermodal railway cars 100 to prevent rocking of such cars during railway transit which has a tendency to introduce an angular moment to the standard railway truck 100.

The angular moment forces of the rocking motion can cause premature wear of components of the standard railway truck 108 if there is any twisting of the standard railway truck 108 itself. The premature wear of standard railway truck 108 components has been solved by the present invention by maintaining the pivot point of the rocking motion angular rotational moment forces for both intermodal railway cars 100 supported by the one standard railway truck 108 on the same axis. If the standard railway truck 108 were bisected along a line parallel to the axles of the wheels and perpendicular to the rails of track, the result would be the X axis shown in FIGS. 2, 3 and 11 on which each side bearing 180 is centered. This side by side centered arrangement or the bifurcated side bearing system 168 keeps the rocking motion of the intermodal railway car 100 from twisting the standard railway truck 108 by absorbing these angular rotational movement forces on the same axis. Thus, this arrangement significantly reduces premature wear problems associated with the standard railway truck 108 components.

The tapering of the I-shaped beam 170 is particularly useful to allow tucking of the extension arms 166 upon bending of the intermodal railway cars 100 in the horizontal angular position. Also the rearward portion of bottom filler plates 178 are tapered down toward the gusset plates 172 to allow tucking of the extension arms 166. The web construction of the extension arms 166 stretches the longitudinal forces which are applied to the intermodal railway cars 100 during such transit. To provide for the uniformity of the angular moment exerted on the extension arms 166 of each intermodal railway car 100, each intermodal railway car 100 will either have two inside extension arms 166 or two outside extension arms 166 as amply seen from the combination of FIGS. 9, 10 and 1. Structured in this fashion, each intermodal railway car 100 will have an independent and equal distant suspension system that will provide for equal tracking of the cars in a unit train consisting of many of such intermodal railway cars 100 having articulated connections 114 between each car 100. Additionally, it is advantageous to have the two outside extension arms 166 on the end of the intermodal railway car 100 containing the tire rest stringers 152 to maximize the stability of the intermodal railway car 100.

Thus, it should be apparent from the foregoing description of the preferred embodiment, that the subject intermodal railway car 100 as herein shown and described accomplishes the objects of the invention and has solved many problems attendent to such intermodal railway cars 100 and their use in the American railroad system to provide intermodal transport of rubber tired vehicle trailers and containers in a fashion which will meet the Plate B requirements of the AAR.

What is claimed is:

1. An intermodal railway car for the transportation of rubber tired vehicle trailers or containers over the railway comprising:

two or more such intermodal railway cars having a number of standard railway trucks equal to the number of intermodal railway cars plus one;

articulated connections on at least one end of each intermodal railway car;

said articulated connections having a stub center sill for pivotal connection to the standard railway truck;

said articulated connections having at least one set of extension arms terminating in a side bearing connection to the standard railway truck;

each said extension arm including an I-shaped beam connected to the intermodal railway car and having an outer sloped end which slopes downwardly in a direction away from the railway car;

a cap plate covering the sloped end of said I-shpaed beam;

a bottom filler plate to provide a resting zone for said extension arm; and at least one vertical tie plate connected between said cap plate and said bottom filler plate to provide reinforcement vertically centered over the center of said side bearing connection to said standard railway truck.

2. An intermodal railway car according to claim 1 wherein said side bearing is part of two bifurcated side bearing systems on each of said standard railway trucks supporting said extension arms of said articulated connection.

* * * * *